US006786502B2

(12) United States Patent
Carlson

(10) Patent No.: US 6,786,502 B2
(45) Date of Patent: Sep. 7, 2004

(54) LONGITUDINALLY ADJUSTABLE MOUNT FOR A SNOWBOARD BINDING

(76) Inventor: Stephen R. Carlson, 798 Brooktree Rd., Pacific Palisades, CA (US) 90272

( * ) Notice: Subject to any disclaimer, the term of this patent is extended or adjusted under 35 U.S.C. 154(b) by 0 days.

(21) Appl. No.: 09/768,955

(22) Filed: Jan. 25, 2001

(65) Prior Publication Data

US 2001/0038182 A1 Nov. 8, 2001

Related U.S. Application Data

(63) Continuation-in-part of application No. 09/205,240, filed on Dec. 2, 1998, now Pat. No. 6,189,899, which is a continuation-in-part of application No. 08/901,387, filed on Jul. 28, 1997, now Pat. No. 6,015,161.

(51) Int. Cl.[7] ..... A63C 9/06; A63C 9/16; B62B 9/04

(52) U.S. Cl. ..... 280/633; 280/14.22; 280/626

(58) Field of Search ..... 280/14.22, 633, 280/628, 623, 618, 634, 617, 627, 626, 607, 630, 629; 414/70, 74; 441/70, 74

(56) References Cited

U.S. PATENT DOCUMENTS

| | | | | | |
|---|---|---|---|---|---|
| 2,740,972 | A | * | 4/1956 | Taylor | 441/70 |
| 2,933,741 | A | * | 4/1960 | Walter | 441/70 |
| 3,102,279 | A | * | 9/1963 | Bennett | 441/70 |
| 3,127,623 | A | * | 4/1964 | Roudebush | 441/70 |
| 4,403,785 | A | * | 9/1983 | Hottel | 280/14.23 |
| 4,565,386 | A | * | 1/1986 | Crainich | 280/602 |
| 4,871,337 | A | * | 10/1989 | Harris | 441/74 |
| 5,021,017 | A | * | 6/1991 | Ott | 441/70 |
| 5,028,068 | A | * | 7/1991 | Donovan | 280/618 |
| 5,156,644 | A | * | 10/1992 | Koehler et al. | 280/14.2 |
| 5,261,689 | A | * | 11/1993 | Carpenter et al. | 280/618 |
| 5,261,698 | A | * | 11/1993 | Yano | 280/808 |
| 5,277,635 | A | * | 1/1994 | Gillis | 441/74 |
| 5,354,088 | A | * | 10/1994 | Vetter et al. | 280/318 |
| 5,356,170 | A | * | 10/1994 | Carpenter et al. | 280/618 |
| 5,433,636 | A | * | 7/1995 | Gillis | 441/74 |
| 5,499,837 | A | * | 3/1996 | Hale et al. | 280/607 |
| 5,577,755 | A | * | 11/1996 | Metzger et al. | 280/607 |
| 5,584,492 | A | * | 12/1996 | Fardie | 280/14.2 |
| 5,586,779 | A | * | 12/1996 | Dawes et al. | 280/14.2 |
| 5,660,410 | A | * | 8/1997 | Alden | 280/627 |
| 5,826,910 | A | * | 10/1998 | Ricks et al. | 280/618 |
| 6,089,581 | A | * | 7/2000 | Partridge | 280/14.2 |
| 6,189,899 | B1 | * | 2/2001 | Carlson | 280/14.22 |

FOREIGN PATENT DOCUMENTS

| | | | | |
|---|---|---|---|---|
| EP | 351298 A1 | * | 1/1990 | 280/618 |
| FR | 2645034 | * | 10/1990 | 280/14.22 |
| FR | 02715861 | * | 8/1995 | 280/618 |
| WO | WO 97/03733 | * | 2/1997 | 280/618 |

* cited by examiner

*Primary Examiner*—Brian L. Johnson
*Assistant Examiner*—G. B. Klebe
(74) *Attorney, Agent, or Firm*—W. Edward Johansen

(57) ABSTRACT

An adjustable mount for use with a snowboard and a snowboard binding has a center-line and a channel which longitudinally extends along the center-line of the snowboard. The snowboard binding includes a binding base plate and a disc. The disc has a center-line and a bottom surface and is rotatably coupled to the binding base plate. The adjustable mount includes a rail and a locking mechanism. The rail is disposed in the channel and is fixedly coupled thereto. The rail is a flexible member and has a key-slot and two series of parallel notches. The binding base plate is disposed on the snowboard. The disc has a center-line and a bottom surface. The disc is rotatably coupled to the binding base plate. The locking mechanism securely couples the rail to the binding base plate.

1 Claim, 10 Drawing Sheets

LONGITUDINALLY ADJUSTABLE MOUNT FOR A SNOWBOARD BINDING

This application is a continuation-in-part of the application filed Dec. 2, 1998 under Ser. No. 09/205,240 now U.S. Pat. No. 6,189,899 which is a continuation-in-part of the application filed Jul. 28, 1997 under Ser. No. 08/901,387, now U.S. Pat. No. 6,015,161.

BACKGROUND OF THE INVENTION

The field of the invention is adjustable mounts for snowboard bindings.

Snowboarding is a sport wherein a person uses a snowboard for recreational travel down a snow-covered inclined surface. A mount fastens a binding to the snowboard. The popularity of snowboarding is growing all over the world. Snowboarding is beginning to rival skiing as a recreational sport. While snowboarding a person stands on the snowboard with both feet and his body angled to the longitudinal axis of the snowboard.

The Revelation snowboard has two sets of two parallel tracks and two sets of four T-nuts. Each set of the four T-nuts float within one of the two sets of the two parallel tracks and mechanically couples one of two bindings to one of the two sets of the two parallel tracks. Revelation has a trademark, FREEDOM GROOVE, and a patent pending for its snowboard.

U.S. Pat. No. 6,089,581 teaches a system which mounts bindings to a snowboard. The system allows relative distance between the mounted bindings to be much more accurately adjusted by the user, making snowboarding mare enjoyable and safer. The system involves a front and a rear set of parallel cavities formed on the top surface of a snowboard. The snowboard accepts nuts. The nuts slide in each cavity. Each nut receives a corresponding bolt from the binding to be mounted. The nuts can be easily replaced if stripped, obviating the need for frequent and expensive repairs to fix stripped nuts, as is common with typical snowboards.

U.S. Pat. No. 5,261,698 teaches a binding whose rotational position relative to an axis perpendicular to a snowboard can be adjusted. The binding includes a hold-down plate and a binding base plate. The hold-down plate may be secured to the snowboard in several different positions on the board and is fixed to the snowboard by screws extending through a set of holes in the hold-down plate. The binding base plate can be rotated relative to the hold-down plate. The binding base plate and the hold-down plate each have ribs or ridges, respectively, which lock the angular position of the binding base plate relative to the hold-down plate. The rotational position of the binding base plate can only be adjusted by removing the boot from the binding base plate and disengaging the screws from the holes in the hold-down plate. Therefore, angular adjustment of the binding cannot be done "on the fly". Some bindings permit a person using a snowboard to adjust their rotational orientation on the snowboard. Look makes a binding which includes a circular plate and a foot-bed. The circular plate is attached to the snowboard by a set of screws. The screws engage with the snowboard. The foot-bed has a central aperture for rotatably receiving the circular plate. A lock assembly locks the foot-bed in a predetermined rotational position with respect to the circular plate. A housing, including one or more fasteners, is attached to the foot-bed for securing a boot to the foot-bed so that the boot cannot be pulled free of the foot-bed except when the fasteners are released. A person adjusts the orientation of the binding at the beginning of the season and often makes no further adjustments.

U.S. Pat. No. 5,577,755 teaches a rotatable binding for a snowboard which includes a base plate and a binding plate. The base plate is mounted on the snowboard. The binding plate is rotatably mounted on the base plate The rotatable binding also includes a locking assembly. The locking assembly includes a pin and a foot binding. The locking assembly selectively locks, at a desired angle of rotation, the binding plate to the base plate. The base plate includes an indexing platform and a pedestal. The pedestal is disposed on the bottom of the base plate. The indexing platform has a multiplicity of bores arranged in a circular arc about a central axis The pedestal has a width about the width of a human foot and traverses the snowboard in order to support the indexing platform above the top surface of the snowboard. The pin does not restrict rotation of the binding base plate relative to the base plate and is selectively moveable from a raised position to a lowered position. The pin engages an indexing bore such that the binding plate may not rotate relative to the base plate.

U.S. Pat. No. 5,028,068 teaches a device which pivotally mounts a binding on a snowboard on the upper surface thereof. A manually operated handle allows the binding to be changed in any direction desired and thereafter with a flip of the handle locked into the selected position. The binding includes a binding base plate and a swivel plate. The binding base plate is mounted on the swivel plate.

U.S. Pat. No. 5,354,088 teaches a coupling which releasably mounts a binding to a turntable. The turntable is adjustably secured to a snowboard.

U.S. Pat. No. 4,871,337 teaches a snowboard in which the rider's feet are positionable within bindings which are formed on first and second riding plates. Each of the first and second riding plates is positionable above a channel section. The channel section is formed within a rider support surface of the riding apparatus. Each riding plate supports fasteners. The fasteners are releasably engageable with retaining elements which are installed within the channel section. After loosening the fasteners from the retaining elements, each of the first and second riding plates may be repositioned angularly or longitudinally with respect to its channel section thereby permitting the snowboard to be used with a variety of stances and leg spacings.

U.S. Pat. No. 5,021,017 teaches a water sports board which has a base formed with rows of detent teeth for locking engagement with the peripheral teeth of binder plates. The binder plate may be angularly or longitudinally adjusted relative to the base. The board also has a pair of boots that are mounted to the binder plates and mounting assemblies for mounting the binder plates to the base.

Today there exits several kinds of water sports boards including surfboards, knee-boards, water skis and boards upon which a rider, towed by a power boat, stands with his feet spread longitudinally apart upon the board. Some of these boards, including the last mentioned type to which this invention particularly pertains, are equipped with foot bindings to stabilize the rider upon the board and to enhance his foot control of the board. With this latter type of board, which has only recently obtained popularity, the rider positions his feet on the board one behind the other at a skewed angle with respect to the longitudinal axis of the board. This posture thus is similar to that used by surfers on surfboards. Initially these types of boards were merely equipped with strips of course, frictional material to provide foot traction. Since they were pulled in tow behind powerful motor boats riders quickly found that they were not able to maintain their feet in position well enough when subjected to strong tow rope pulling forces. These types of water sports boards are equipped with foot bindings. Water ski foot bindings include a toe piece and a heal piece mounted to the top surface of the ski. One of the pieces is usually adjustable to accommodate different skier foot sizes and to facilitate foot entry. These are shown in U.S. Pat. No. 2,933,741, U.S. Pat. Nos. 3,102,279 and 3,127,623. Water ski bindings have also existed by which the position of the whole binding for one foot may be repositioned upon the ski. Exemplary of this type of binding is that shown in U.S. Pat. No. 2,740,972. These water ski bindings however do not provide for angular foot adjustment since water skiing is best done with the skier's feet aligned with the skis. Recently, a board known as a Skurfer has been equipped with bindings that can be adjusted both longitudinally and angularly. Its bindings include oblong plates upon which toe and heal pieces, hereinafter collectively referred to as "boots", are mounted. The plates are held in position by threaded posts that extend through arcuate slots in holding the plates firmly in place at selected positions upon the board. Though these types of bindings have permitted both longitudinal and angular positioning, they have tended to loosen and skew in operation. Also, their degree of angular adjustment has been limited. It thus is seen that a water sports board of the type having foot bindings which can be more fully adjusted rotationally, as well as longitudinally adjusted, and which may be easily yet securely repositioned, has remained an elusive goal.

U.S. Pat. No. 5,433,636 teaches a snowboard having a channel extending along a portion of the length thereof. Two bindings are secured to the snowboard through the channel. Each binding may be rotated between a locked starting position in which the long axis of the binding extends parallel to the long axis of the snowboard and a locked skiing position in which the long axis of the binding extends transversely to the long axis of the snowboard. After the binding has been rotated to a selected position, the binding is secured in place by a locking mechanism. Each binding includes a resilient front strap assembly and a resilient heel support which secures one of the user's feet to the binding and permits a user to quickly and easily remove his feet from the bindings in the event of a fall.

U.S. Pat. No. 5,584,492 teaches an adjustable snowboard binding which can be rotatably controlled without the use of external tools. A boot-mounting platform has a plurality of inwardly facing radial teeth along the circumference of a centralized circular cutout. A circumferential lip along the cutout is used to rotatably mount the platform via overlapping lipped quadrant segments which are mounted to the snowboard. Two radially sliding segments have teeth at their outer ends and are held by the quadrant segments. A slidable band is mounted by actuating locking levers along the longitudinal length of the snowboard. The slidable band has upwardly extending posts. The posts interface with angled slots formed in each sliding segment. In operation, the actuating levers are unlocked and the band slides forwards and backwards to effectuate radial movement of the sliding segments. This in turn effectuates locking engagement and disengagement between the radial circumferential teeth and the sliding segment teeth. The user performs this adjustment operation without removing the boot from the mounting platform and without loosening screws.

U.S. Pat. No. 5,586,779 teaches a binding which includes a mount-plate. The mount plate is fixedly mounted to a snowboard. The mount plate has a cavity centrally defined therein. A ring is fixedly attached to the mount plate. The mount plate has a bore centrally defined therethrough. A hub mounts the binding to the snowboard. The hub is centrally disposed in the cavity and extends through the bore. The mount plate is free to rotate about the hub thereby allowing for adjustment of an angular position of the mount plate. A locking mechanism arrests and releases rotation of the mount plate thereby allowing the angular position of the mount plate to be adjusted. A user may quickly and easily adjust the angular position of binding relative to the snowboard without removing his boot from the binding.

U.S. Pat. No. 5,826,910 teaches a swivelable bindings assembly for use with a snowboard which makes a selective rotational adjustment of the bindings about an axis normal to the upper surface of the snowboard and which includes a rotatably adjustable bindings plate having a bottom surface, an upper portion adapted for releasably supporting a user's boot, and a relatively large diameter circular opening in the central portion of the plate. The assembly includes a holds-down disk that is received in the plate opening and is adapted to slidably engage edge portions of the plate opening to restrain the plate against upward separation from the disk and to hold the plate with its bottom surface slidably engaged with, and vertically supported by, the low-friction planar surface of a sheet of material secured to the top of the snowboard, the disk also serving to mount the plate for rotation about an axis through the center of the disk. Mechanism for releasably locking the plate at selected rotational positions includes a locking pin with an elongate shaft that engages a horizontal bore extending from an edge of the base plate to the base plate opening, the plate being rotatable to bring the bore in alignment with at least one recess in the outer edge of the disk whereby the pin shaft can be engaged in a selected recess to secure the plate against rotation. These bindings for snowboards can be adjusted with respect to its angular orientation to the longitudinal centerline of the snowboard. The recent surge in popularity of the sport of snowboarding has brought renewed interest in addressing certain problems that are unique to the sport, as opposed to other skiing endeavors such as alpine skiing and water skiing. First, it is noted that according to the conventional arrangement of bindings on a snowboard, fore and aft binding assemblies are secured to the board in a manner to support both feet at a substantial angle with respect to the longitudinal centerline of the board. This cross orientation of the bindings allows the user to assume a side-forward position necessary for optimum control of the board during active snowboarding. It is also noted that snowboarders often desire to modify the angle of the feet relative to the centerline of the board to achieve maximum performance during their run. Such changes in the angle of the feet can be necessitated by the degree of incline of the slope, the amount and quality of the snow encountered, or the amount of jumping desired during descent. When a down-hill run is completed it is necessary for the user to use self- propulsion methods to maneuver over flat terrain and to negotiate the life line and to get in position for pick up by a lift chair. In order to do this the snowboarder will commonly release the aft foot from its bindings so that he or she can use a "skateboarding" technique in which the free foot is used for propulsion. Unfortunately, because of the transverse orientation of the secured foot and the face-forward position that the maneuvering snowboarder tries to assume, the leg is forced towards an unnatural position causing stress and strain on the entire leg, including the vulnerable ankle and knee joints. Of course the snowboarder has the option of detaching both feet from the board and hand carrying the board in such circumstances, but such procedure is inconvenient and time consuming. Furthermore, the cross-orientation of the bindings can lead to difficulties when riding the lift chair, requiring the board to be held in an unwieldy manner that can interfere with a companion lift chair rider, and also causing stress and strain in the secured leg of the user. It has become evident that one way to address these problems would be in providing bindings that are adjustable with respect to their angular orientations to the board centerline.

World Patent No. 97/03733 teaches a device for positioning longitudinally a snowboard binding on a snowboard. The snowboard binding includes a binding plate. A rail is attached to the snowboard. The device includes a sliding member and a central stud. The central stud couples the sliding member to the rail section.

French Patent No. 2,715,861 teaches a single central bolt which anchors a base plate of a snowboard. A C-shaped piece is anchored in the snowboard.

European Patent No. 351,298 teaches a device for positioning longitudinally a snowboard binding on a snowboard. U.S. Pat. No. 5,660,410 teaches a snowboard binding system. U.S. Pat. Nos. 5,261,689 and 5,356,170 also teach other snowboard binding systems of a popular type that which employ a hold-down disk that engages a circular opening in a boot mounting plate whose bottom is supported on a snowboard. Vertical bores through the hold-down disk allow it to be secured to threaded bores in the board using threaded bolts or screws, and ordinarily there are extra pairs of threaded bores in the board to allow adjustment between the fore and aft bindings in several different longitudinal positions, to accommodate the desired feet-apart stance of the rider. There are ridges or splines on the hold-down disk that engage complementary ridges or splines on the binding plate, to secure the plate at a given angular orientation. This will allow angular adjustment of the bindings, but unfortunately, to accomplish this, several bolts per hold-down disk, usually four, must be loosened using a suitable tool in order to loosen the disk sufficiently form the plate to allow rotation of the plate to a new orientation. The fasteners must then be retightened. Unfortunately, while the systems shown in above-mentioned patents allow angular adjustment, they share the major drawback in not allowing such adjustment to be made quickly, easily and conveniently, because they require removal of the boot from the bindings in each case, and the use of tools to loosen and tighten the fasteners.

U.S. Pat. No. 5,354,088 teaches a snowboard binding which can be rapidly and easily removed from the board, should this be a solution to the above-discussed problems, but this disclosure does not show a means for rapidly adjusting the angle of the bindings. Relatively recent approaches to the need for rotatably adjustable bindings are revealed in U.S. Pat. No. 5,277,635 which teaches a system which is suited for use on water ski boards, however it appears that the locking mechanism would not be adequate for use in a snowboard environment. U.S. Pat. No. 5,499,837 teaches a locking mechanism which depends on specially formed vertically opposed undulating surfaces that can be brought in and out of engagement and which appears complex and expensive.

SUMMARY OF INVENTION

The present invention is generally directed to an adjustable mount for a snowboard binding. A snowboard is of a sandwich construction and includes a polyethylene base, a first fiberglass layer, a wood core, a second fiberglass layer and a plastic top sheet. The snowboard has a center-line. The snowboard binding includes a binding base plate and a disc. The binding base plate is disposed on the snowboard. The disc has a center-line and a bottom surface. The disc is rotatably coupled to the binding base plate.

In a first separate aspect of the present invention, the snowboard has a channel which longitudinally extends along the center-line in the wood core, the second fiberglass layer and the plastic top sheet thereof. The mount includes a rail. The rail is disposed in the channel and is fixedly coupled thereto. The rail has two parallel series of notches. The locking mechanism securely couples the rail to the disc.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENT

Figure 1:
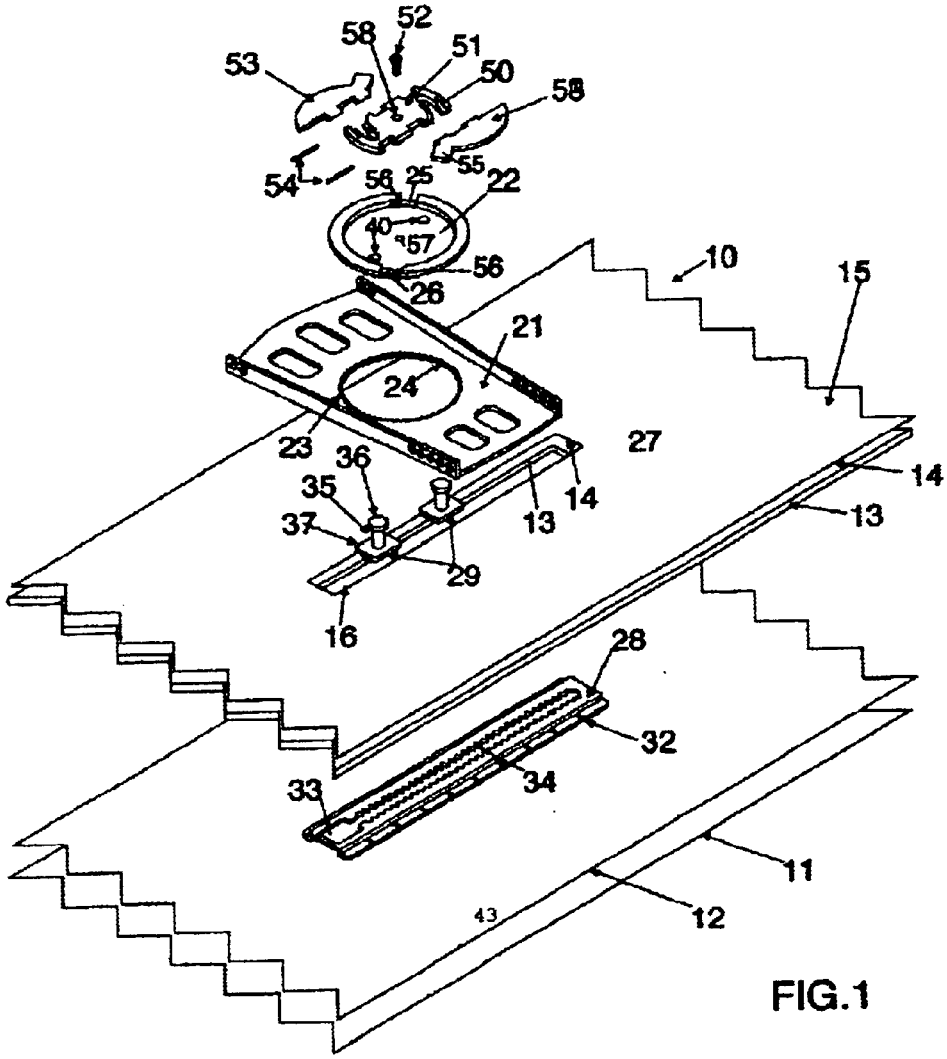
FIG. 1 is an exploded perspective drawing of a snowboard, a snowboard binding including a binding base plate and a disc and an adjustable mount including a rail and a locking mechanism including a lock plate and two handles each of which has a safety tab.

Referring to FIG. 1 a snowboard 10 is of a sandwich construction and includes a polyethylene base 11, a first fiberglass layer 12, a wood core 13, a second fiberglass layer 14 and a plastic top sheet 15. The snowboard 10 has a center-line. A channel 16 longitudinally extends along the center-line in the wood core 13, the second fiberglass layer 14 and the plastic top sheet. A snowboard binding 20 includes a binding base plate 21 and a disc 22. The binding base plate 21 has a bore 23 with a plurality of inwardly directed, radially disposed teeth 24. The disc 22 has a circular peripheral side edge 25 with a plurality of outwardly directed, radially disposed teeth 26. The disc 22 is lifted away from the binding base plate 21 so that the binding base plate 21 can be rotatably adjusted. Once the binding base plate 21 has been rotatably adjusted the disc 22 is placed on the binding base plate 21 so that each of the outwardly directed, radially disposed teeth 26 of the disc 22 engages one of the inwardly directed, radially disposed teeth 24 of the binding base plate 21 in order to rotatably lock the binding base plate 21 in place relative to the disc 22. A mount 27 includes a rail 28 and two mounting pins 29.

Figure 2:
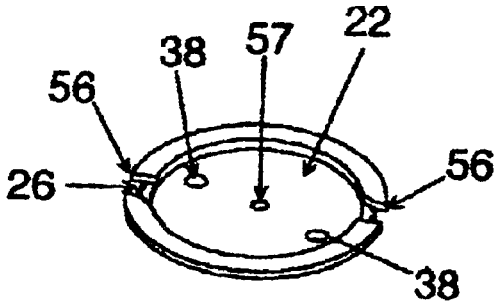
FIG. 2 is a perspective drawing of the disc of FIG. 1.
Figure 3:
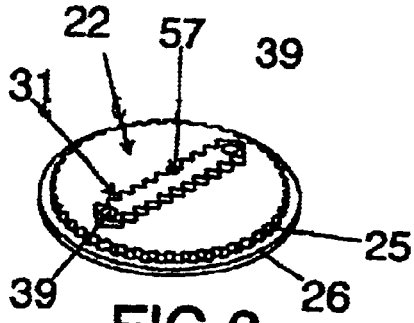
FIG. 3 is a perspective drawing of the disc of FIG. 1 after the disc has been turned over.

Referring to FIG. 1 in conjunction with FIG. 2 and FIG. 3 the disc 22 has a center-line and a bottom surface. A bar 30 is disposed on the bottom surface of the disc 22 about the center-line thereof and is fixedly coupled thereto. The bar 30 has two peripheral edges each of which has two opposing and parallel series of notches 31.

Figure 4:
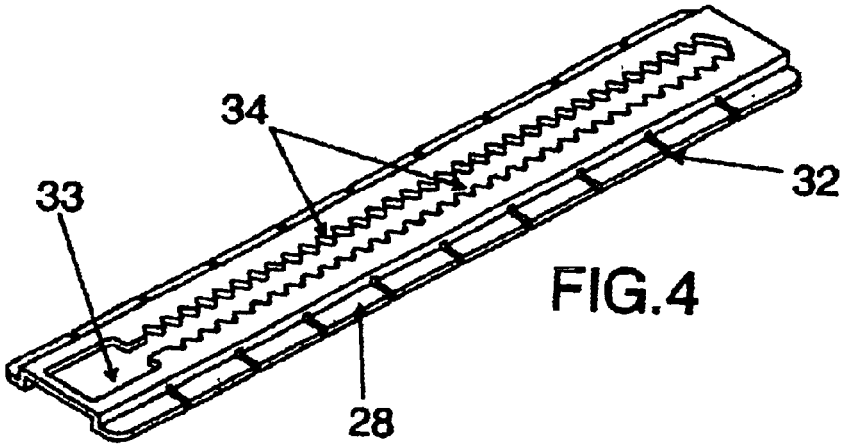
FIG. 4 is a perspective drawing of the rail of FIG. 1.

Referring to FIG. 1 in conjunction with FIG. 4 the rail 28 is a flexible member and has two sets of pluralities of slots 32 each of which extends along its side edges, a key slot 33 of a rectangular dimension and two opposing and parallel series of notches 34. The rail 28 is disposed in the channel 16 and is fixedly coupled thereto. Each mounting pin 29 includes a cylindrical shaft 35, a flat, disc-shaped cap 36 and a rectangular base 37. The flat, rectangular base 37 is of a rectangular dimension slightly smaller than the rectangular dimension of the key slot 33. The disc 22 has two bores 38 which are disposed on the center-line thereof. The bar 30 has two bores 39 each of which is aligned with one of the bores 38 of the disc 22 to form two sets of bores 40. The flat, disc-shaped cap 36 is fixedly coupled to the cylindrical shaft 35 at one end thereof. When the cylindrical shaft 35 of each mounting pin 29 has been inserted into one of the two sets of bores 40, the flat, rectangular base 37 is fixedly coupled to the cylindrical shaft 35 at the other end thereof in order to loosely secure the cylindrical shaft 35 of each mounting pin 29 within one of the two sets of bores 40. Each mounting pin 29 is slidably coupled to the rail 28 when its flat, rectangular base 37 is inserted into the key slot 33.

Figure 5:
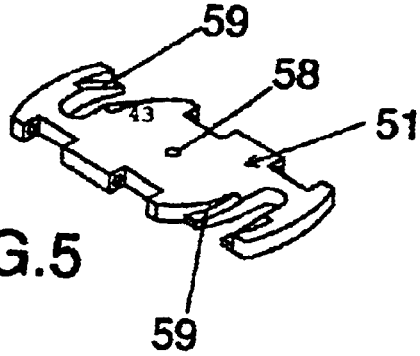
FIG. 5 is a perspective drawing of the lock plate of FIG. 1.

Referring to FIG. 1 in conjunction with FIG. 5 a locking mechanism 50 includes a lock plate 51, a screw 52 of a diameter, two handles 53, two pins 54. Each handle 53 has a safety tab 55. The disc 22 has two safety slots 56. Each pin 54 rotatably couples the one of the handles 53 to the lock plate 51. Each safety tab 55 is disengageably coupled to one of the safety slots 56. The disc 22 has a threaded bore 57 which is axially disposed. The lock plate 51 has a bore 58 which is axially disposed and which is of a diameter slightly larger than the diameter of the screw 52. The screw 52 is inserted into the bore 58 of the lock plate 51 and is then threaded into the threaded bore 57 of the disc 22 thereby rotatably coupling the lock plate 51 to the disc 22. The lock plate 51 has two curved ramps 59 which are oppositely disposed. The cylindrical shaft 35 of each mounting pin 29 is slidably coupled to one of the curved ramps 59. The flat, disc-shaped cap 36 of each mounting pin 29 secures it therein.

Figure 6:
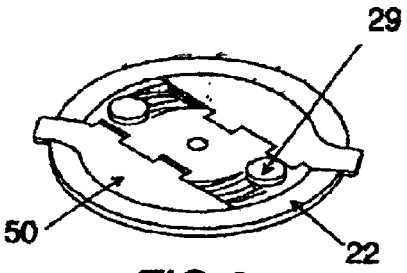
FIG. 6 is a schematic drawing of the locking mechanism of FIG. 1 when locked with the safety tabs engaged.

Referring to FIG. 1 in conjunction with FIG. 6 when the locking mechanism 50 is locked and each safety tab 55 engages one of the safety slots 56. Each series of notches 34 of the rail 28 engages one of the series of notches 31 of the bar 30 so that the snowboard binding 20 can not be adjusted longitudinally relative to the snowboard 10.

Figure 7:
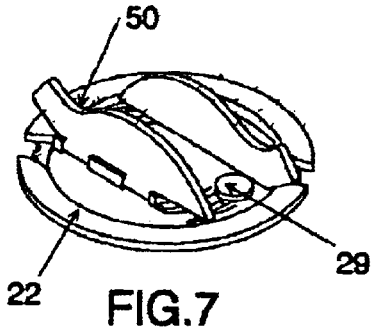
FIG. 7 is a schematic drawing of the locking mechanism of FIG. 1 when locked with the safety tabs disengaged.
Figure 8:
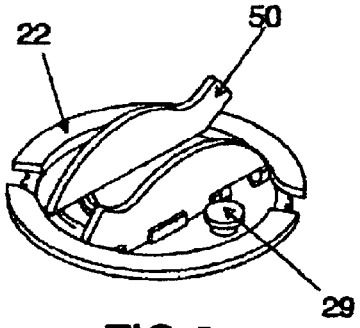
FIG. 8 is a schematic drawing of the locking mechanism of FIG. 1 when unlocked.

Referring to FIG. 1 in conjunction with FIG. 7 and FIG. 8 when the locking mechanism 50 is locked and each safety tab 55 has disengaged itself from one of the safety slots 56. A snowboarder may use the handles 53 to rotate the lock plate 51 in order to unlock it and release the disc 22 from the binding base plate 21 and the rail 28.

Figure 9:
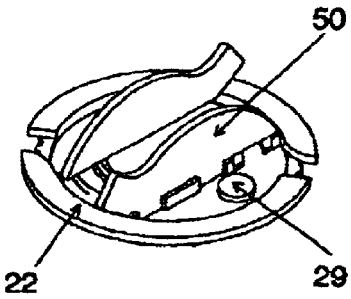
FIG. 9 is a schematic drawing of the locking mechanism of FIG. 1 when unlocked and released.

Referring to FIG. 1 in conjunction with FIG. 9 and FIG. 8 when the locking mechanism 50 is unlocked and released. By lifting the disc 22 from the rail each series of notches 34 of the rail 28 is disengaged from one of the series of notches 31 of the bar 30 so that the snowboard binding 20 can be adjusted longitudinally relative to the snowboard 10.

Figure 10:
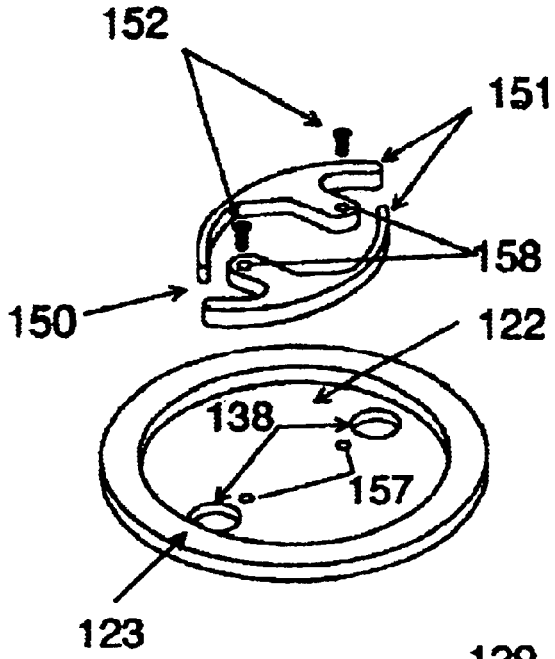
FIG. 10 is an exploded perspective drawing of a disc of a snowboard binding and two locking levers of a locking mechanism.
Figure 11:
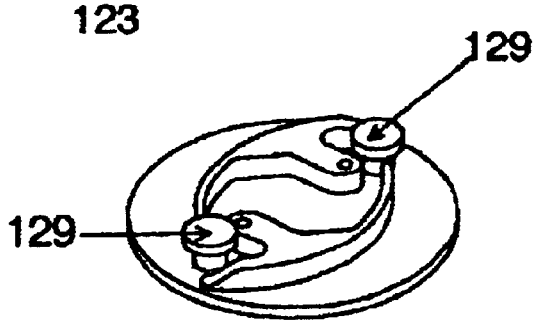
FIG. 11 is a schematic drawing of the locking mechanism of FIG. 10 when locked.
Figure 12:
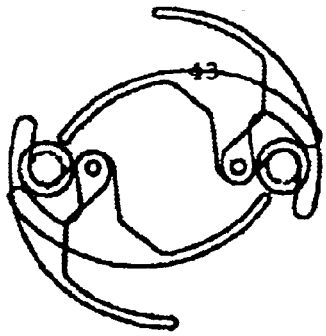
FIG. 12 is a schematic drawing of the locking mechanism of FIG. 10 when unlocked and released.

Referring to FIG. 10 in conjunction with FIG. 11 and FIG. 12 a snowboard binding includes a binding base plate and a disc 122. The disc 122 has a circular peripheral side edge 123 with a plurality of outwardly directed, radially disposed teeth. The disc 122 is lifted away from the binding base plate so that the binding base plate can be rotatably adjusted. Once the binding base plate has been rotatably adjusted the disc is placed on the binding base plate so that all of the outwardly directed, radially disposed teeth of the disc 122 engage all of the inwardly directed, radially disposed teeth of the binding base plate in order to rotatably lock the binding base plate in place relative to the disc 122. A mount includes two mounting pins 129. The disc 122 has a center-line and a bottom surface. The disc 122 has two bores 138 which are disposed on the center-line thereof A locking mechanism 150 includes two locking levers 151 and two screws 152 of a diameter. The disc 122 has two threaded bores 157 each of which is disposed adjacent to one of the two bores thereof. Each locking lever 151 has a bore 158 which is of a diameter slightly larger than the diameter of each screw 152. Each screw 152 is inserted into the bore 158 of one of the locking levers 151 and is then threaded into the threaded bore 157 of the disc 122 thereby rotatably coupling each of the locking levers 151 to the disc 122. Each locking lever 151 engages the cylindrical shaft of one of mounting pins 129 in order to lock the disc 122 in place. Each locking lever 151 disengages itself from the cylindrical shaft of one of mounting pins 129 in order to unlock the disc 122 in place so that the snowboard binding can be adjusted longitudinally relative to the snowboard.

Figure 13:
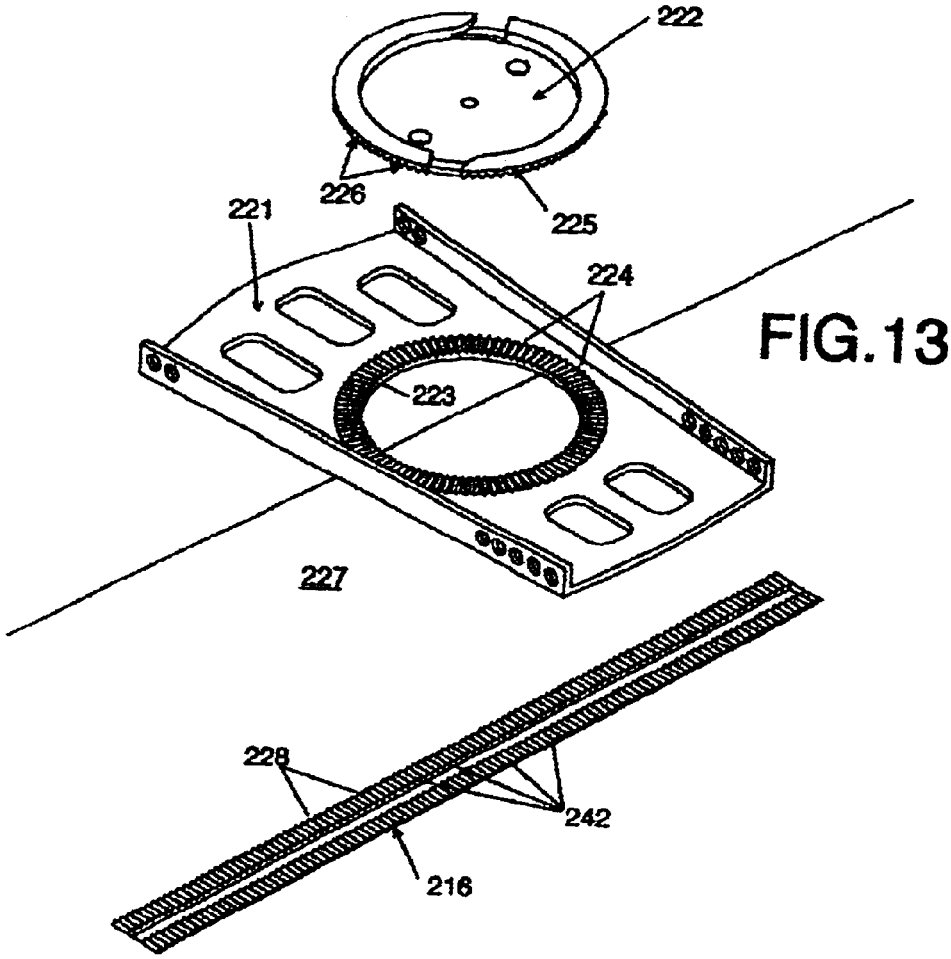
FIG. 13 is a partial, exploded perspective drawing of a snowboard, a snowboard binding including a binding base plate and a disc and an adjustable mount including a rail.
Figure 14:
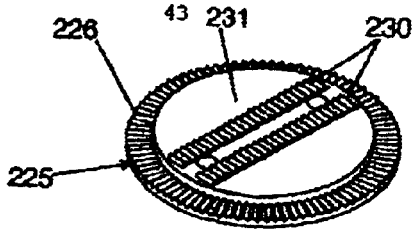
FIG. 14 is a perspective drawing of the disc of FIG. 13 after the disc has been turned over.

Referring to FIG. 13 in conjunction with FIG. 14 a snowboard 210 has a channel 216. A snowboard binding 220 includes a binding base plate 221 and a disc 222. The binding base plate 221 has a bore 223 with a plurality of upwardly directed, radially disposed teeth 224. The disc 222 has a circular peripheral side edge 225 with a plurality of downwardly directed, radially disposed teeth 226. The disc 222 is lifted away from the binding base plate 221 so that the binding base plate 221 can be rotatably adjusted. Once the binding base plate 221 has been rotatably adjusted the disc 222 is placed on the binding base plate 221 so that all of the downwardly directed, radially disposed teeth 226 of the disc 222 engage all of the upwardly directed, radially disposed teeth 224 of the binding base plate 221 in order to rotatably lock the binding base plate 221 in place relative to the disc 222. A mount 227 includes two rails 228 and two mounting pins.

Still referring to FIG. 13 in conjunction with FIG. 14 the disc 222 has a center-line and a bottom surface. Two bars 230 are oppositely and parallelly disposed on the bottom surface of the disc 222 about the center-line thereof and are fixedly coupled thereto. Each bar 230 has a series of downwardly directed notches 231. The rails 228 are disposed in the channel 216 and is fixedly coupled thereto. Each rail 228 has a series of upwardly directed notches 242.

Figure 15:
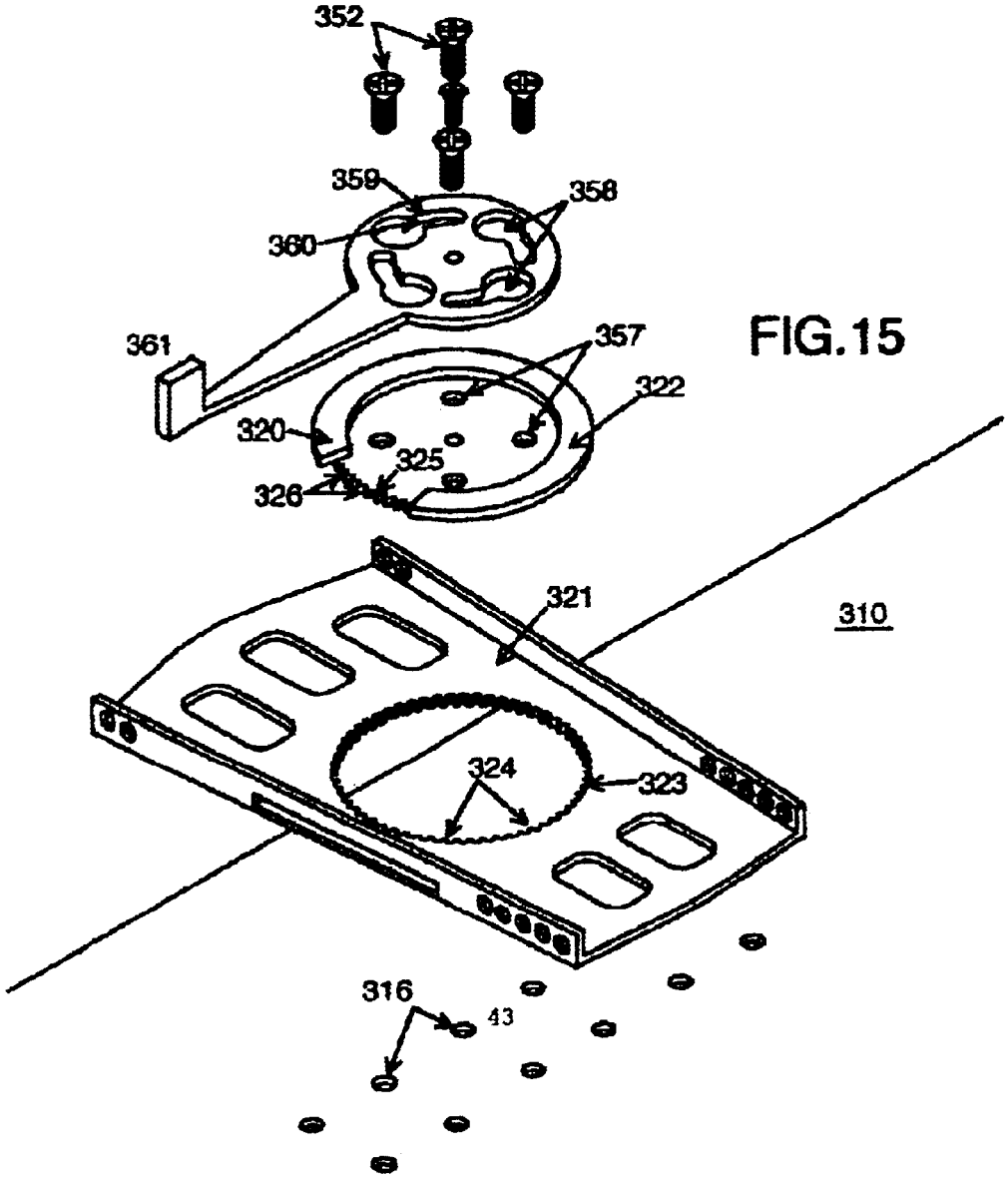
FIG. 15 is an exploded perspective drawing of a snowboard, a snowboard binding including a binding base plate, a disc and a lock plate.

Referring to FIG. 15 a snowboard 310 is of a sandwich construction and includes a polyethylene base, a first fiberglass layer, a wood core, a second fiberglass layer and a plastic top sheet 315. The snowboard 310 has a center-line. Two parallel and opposing series of threaded bores 316 longitudinally extend about the center-line in the snowboard 310. A snowboard binding 320 includes a binding base plate 321 and a disc 322. The binding base plate 321 has a bore 323 with a plurality of inwardly directed, radially disposed teeth 324. The disc 322 has a circular peripheral side edge 325 with a plurality of outwardly directed, radially disposed teeth 326. The disc 322 is lifted away from the binding base plate 321 so that the binding base plate 321 can be rotatably adjusted. Once the binding base plate 321 has been rotatably adjusted the disc 322 is placed on the binding base plate 321 so that each of the outwardly directed, radially disposed teeth 326 of the disc 322 engages one of the inwardly directed, radially disposed teeth 324 of the binding base plate 321 in order to rotatably lock the binding base plate 321 in place relative to the disc 322.

Still referring to FIG. 15 a locking mechanism 350 includes a lock plate 351, four screws 352. The disc 322 has a center axis and four threaded bores 357 each of which is disposed about the center axis thereof. The lock plate 351 has a center axis and four bores 358 each of which is disposed about the center axis thereof. Each bore 358 of the lock plate 351 is of a diameter slightly larger than the diameter of one of the screws 352. Each screw 352 is inserted into one of the four bores 358 of the lock plate 351 and is then threaded into one of the four threaded bores 357 of the disc 322 thereby coupling the lock plate 351 to the disc 322. The lock plate 351 has four curved slots 359 which are disposed about the center axis thereof. Each curved slot 359 has within it a curved ramp 360. Each curved slot 359 is disposed adjacent and contiguous to one of the four bores 358 of the lock plate 351. The lock plate 351 has a handle 361. A snowboarder may use the handle 361 to rotate the lock plate 351 in order to unlock it and release the disc 322 from the binding base plate 320 The snowboard binding of U.S. Pat. No. 5,261,698 includes a hold-down plate and a binding base plate. The hold-down plate is fixed to the snowboard by four screws extending through a set of four holes in the hold-down plate. The binding base plate can be rotated relative to the hold-down plate. The binding base plate and the hold-down plate each have ribs or ridges, respectively, which lock the angular position of the binding base plate relative to the hold-down plate. The rotational position of the binding base plate can only be adjusted by removing the boot from the binding base plate and disengaging the screws from the holes in the hold-down plate. The disc 322 and the lock plate 351 may replace the hold-down plate. Similarly two snowboard bindings 320 each of which includes the binding base plate 321, the disc 322 and the lock plate 351 may be used with the snowboard which Revelation Snowboard makes. The snowboard has two sets of two parallel tracks and two sets of four T-nuts. Each set of the four T-nuts float within one of the two sets of the two parallel tracks and mechanically couples one of two snowboard bindings 320 to one of the two sets of the two parallel tracks. Revelation Snowboard has a trademark, FREEDOM GROOVE, and a patent pending for its snowboard.

Figure 16:
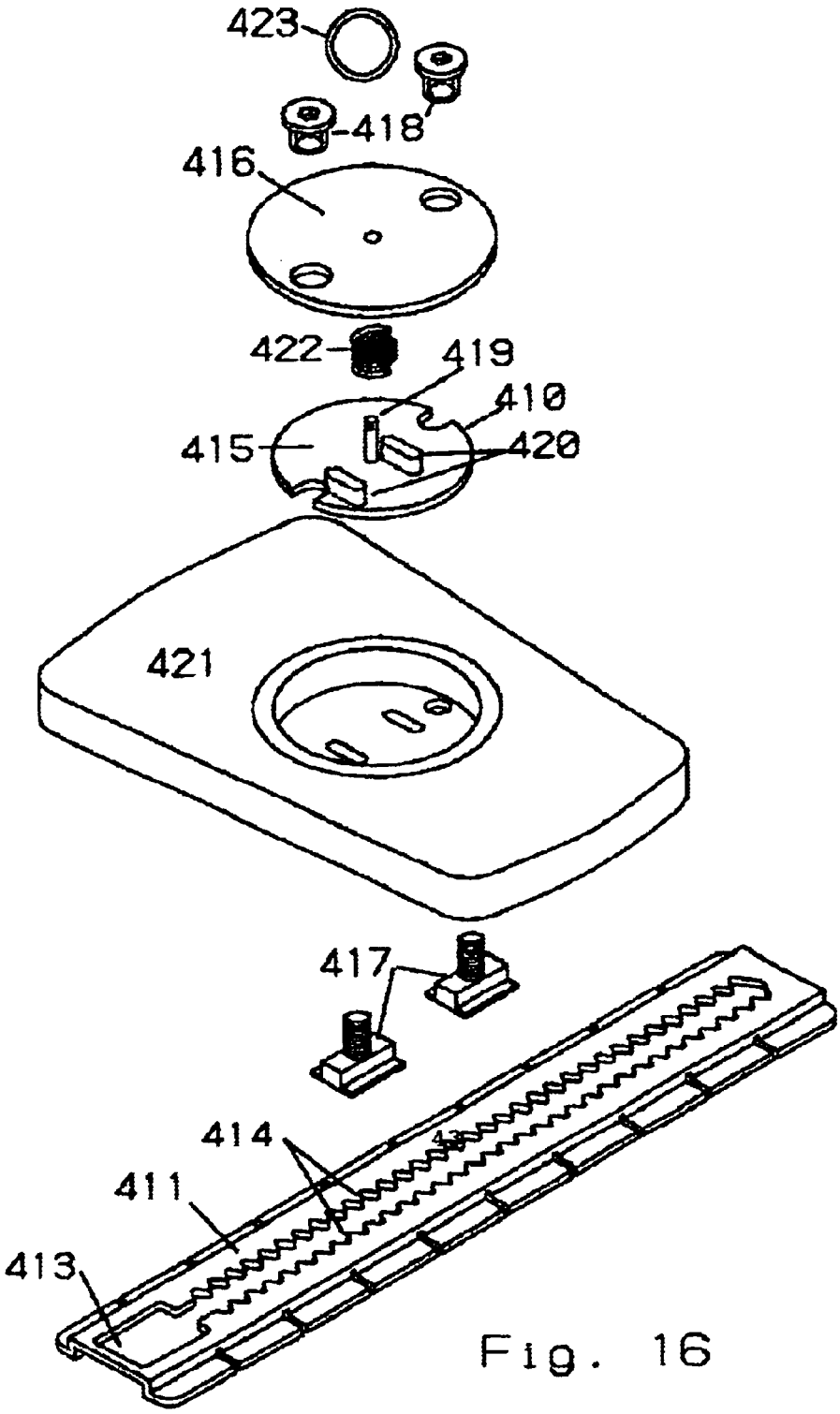
FIG. 16 is an exploded perspective drawing of a snowboard binding including a binding base plate and a disc and an adjustable mount including a rail and a locking mechanism including a lock plate and slider-bolts according to the fifth embodiment.
Figure 17:
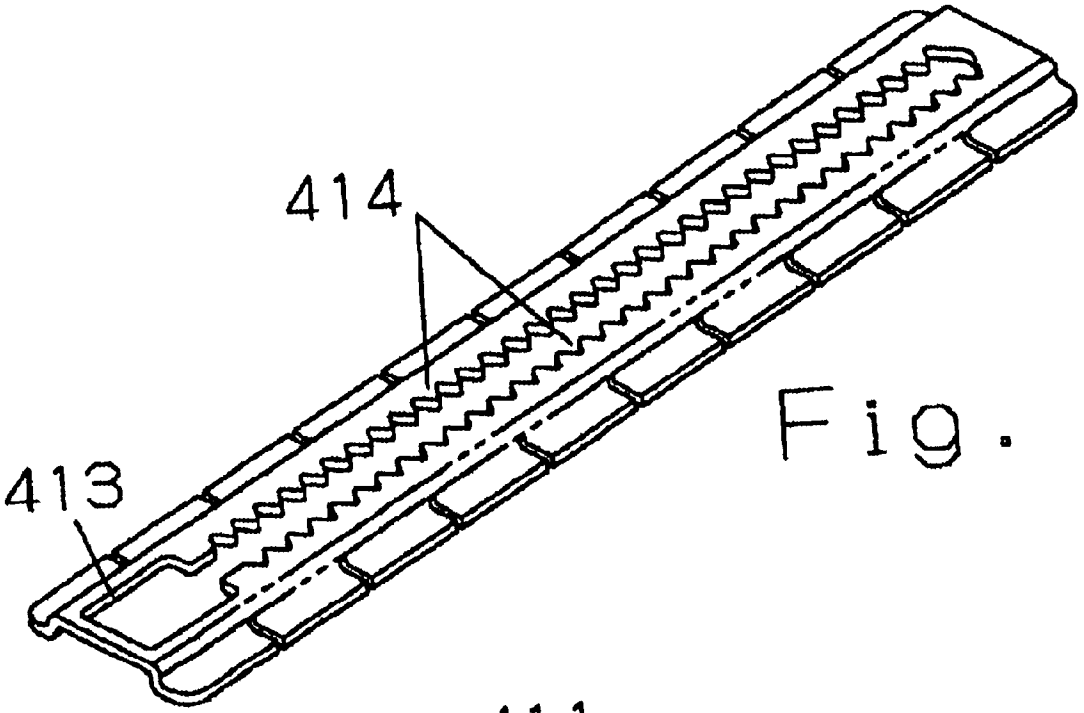
FIG. 17 is a perspective drawing of the rail of FIG. 16.
Figure 18:
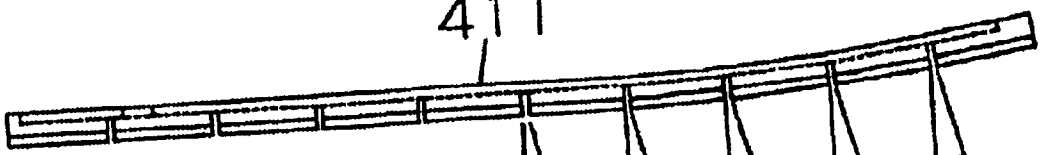
FIG. 18 is a side elevation view of the rail of FIG. 16.

Referring to FIG. 16 in conjunction with FIG. 17 and FIG. 18 an adjustable mount 410 includes a rail 411 and a locking mechanism 412. The rail 411 has a key-slot 413 and a plurality of teeth 414. The rail is coupled to a snowboard. The locking mechanism 412 includes a lock plate 415 and a disc 416, two slider-bolts 417 and two t-nuts 418. The lock plate 415 has a post 419 and protrusions 420. The post 419 and protrusions 420 are disposed on the underside of the lock plate 415. A snowboard binding includes a binding base plate 421. The adjustable mount 410 couples the binding base plate 421 of the snowboard binding to the rail 411 on the snowboard.

Figures 19, 20:
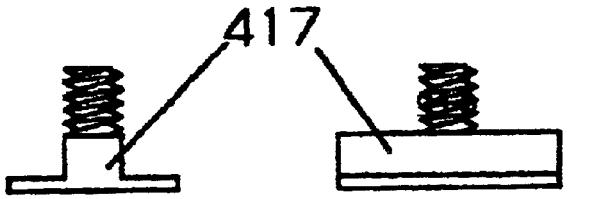
FIG. 19 is a side elevation view of one of the slider-bolts of FIG. 16.
FIG. 20 is a front elevation view of one of the slider-bolts of FIG. 16.

Referring to FIG. 16 in conjunction with FIG. 19 and FIG. 20 the adjustable mount 410 is secured by using the slider-bolts 417 which are inserted into the key-slot 413 and engage the rail 411 by means of the teeth 414 of the rail 411. Once the slider-bolts 417 are engaged within the teeth 414 of the rail 411 the binding base plate 421 is attached by means of holes located in a central bore of the binding base plate 421. The disc 416 is used to help secure the binding base plate 421 to the rail 411 by means of t-nuts 418 which are attached to the slider-bolts 417 at their threaded protrusions. A raised central bar of each slider-bolt 417 allows enough space between the binding base plate 421 and the rail 411 so that the binding base plate 421 can freely move the length of the rail 411. The locking mechanism 412 also includes a spring 422 and a ring 423.

Figure 21:
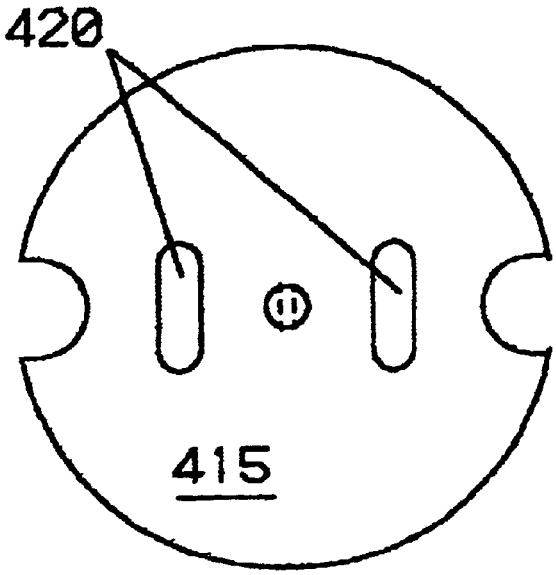
FIG. 21 is a side elevation view of the lock plate of FIG. 16.
Figure 22:
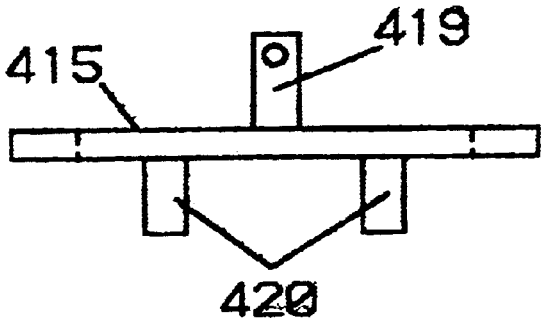
FIG. 22 is a side elevation view of the lock plate of FIG. 16 after the lock plate has been turned over.

Referring to FIG. 16 in conjunction with FIG. 21 and FIG. 22 movement of the binding base plate 421 along the rail 411 is controlled incrementally by the protrusions 420 of the lock plate 415 which is housed in the central bore of the binding base plate 421. The protrusions 421 extend through the holes and interlock with the teeth 414 of the rail 411. The protrusions 420 are held secure by the spring 422. The spring 422 applies downward pressure to the lock plate 415. The protrusions 420 must be disengaged from the teeth 414 in order to move the binding base plate 421 along the rail 411. Disengagement is accomplished by the lifting the ring 423. The ring 423 is attached to the lock plate 415 by means of the post 419. Once disengaged the binding base plate 421 is free to move along rail 411. When the ring 423 is released the spring 422 forces the protrusions 420 to secure themselves in the teeth 414 of the rail 411 disallowing any further movement of the binding base plate 421 along the rail 411.

Figure 23:
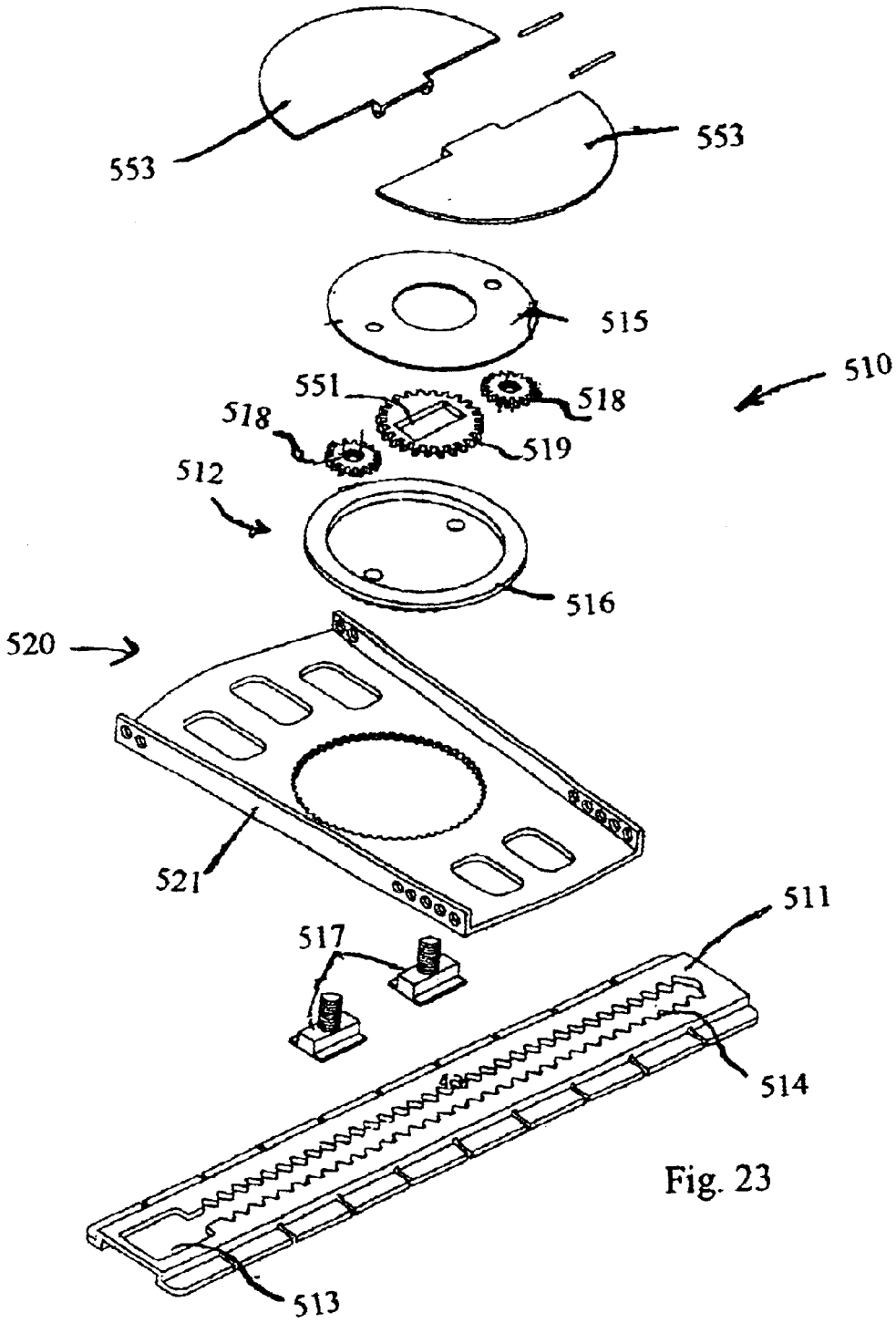
FIG. 23 is an exploded perspective drawing of a snowboard binding including a binding base plate and a disc and an adjustable mount including a rail and a locking mechanism including a lock plate and slider-bolts according to the first embodiment.

Referring to FIG. 23 an adjustable mount 510 includes a rail 511 and a locking mechanism 512. The rail 511 has a key-slot 513 and a plurality of teeth 514. The rail is coupled to a snowboard. The locking mechanism 512 includes a lock plate 515 and a disc 516, two slider-bolts 517, two gear-nuts 518 and a main gear 519. The main gear 519 engages both of the two gear-nuts 518. A snowboard binding 520 includes a binding base plate 521. The adjustable mount 510 couples the binding base plate 521 of the snowboard binding 520 to the rail 511 on the snowboard.

Still referring to FIG. 23 the adjustable mount 510 is secured by using the slider-bolts 517 which are inserted into the key-slot 513 and engage the rail 511 by means of the teeth 514 of the rail 511 Once the slider-bolts 517 are engaged within the teeth 514 of the rail 511 the binding base plate 521 is attached by means of holes located in a central bore of the binding base plate 521. The disc 516 is used to help secure the binding base plate 521 to the rail 511 by means of gear/nuts 518 which are threadedly coupled to the slider-bolts 517 at their threaded protrusions. A raised central bar of each slider-bolt 517 allows enough space between the bindings base plate 521 and the rail 511 so that the binding base plate 521 can freely move the length of the rail 511. The main gear 519 has a slot 551. The locking mechanism 512 also includes handles 553 which engage the slot in the main gear 519. When the locking mechanism 512 is locked a snowboarder may use the handles 553 to rotate the lock plate 515 in order to unlock the locking mechanism 512 and release the disc 516 from the binding base plate 521 and the rail 511.

Referring again to FIG. 1, FIG. 16 and FIG. 23 the rails 28, 411 and 511 are each flexible members. This is an essential feature of the adjustable mounts 10, 410 and 510 when they are used to couple binding base plate 21, 421 and 521, respectively, to a snowboard 11.

From the foregoing it can be seen that a longitudinally adjustable mount for a snowboard binding has been described. It should be noted that the sketches are not drawn to scale and that distances of and between the figures are not to be considered significant.

Accordingly it is intended that the foregoing disclosure and showing made in the drawing shall be considered only as an illustration of the principle of the present invention.

What is claimed is:

1. A locking mechanism for use with a combination snowboard, binding and mount including:

a. a snowboard having a center-line wherein the snowboard has a channel longitudinally extending along the center-line;

b. a rail disposed in said channel and fixedly coupled thereto wherein the rail is a flexible member and has a key-slot and two series of parallel teeth; and c. a binding base plate disposed on the snowboard, said locking mechanism comprising:

a. a lock plate;

b. a disc being rotatably coupled to the binding base plate c. a pair of slider-bolts each of which has a threaded protrusion and a raised central bar whereby each slider-bolt is inserted into the key-slot and engages the teeth of the rail and whereby said raised central bar of each of said slider-bolts allows enough space between the binding base plate and the rail so that the binding base plate can freely move the length of the rail;

d. a pair of gear-nuts each of which is threadedly coupled to one of said slider-bolts at their threaded protrusions;

e. a main gear having a slot whereby said main gear engages both of said gear-nuts; and f. a pair of handles whereby each of said handles is coupled to said slot in said main gear so that when said locking mechanism is locked, said handles may be used to rotate said lock plate in order to unlock said locking mechanism and release said disc from the binding base plate and the rail.

* * * * *